US007507085B2

(12) United States Patent
Happe et al.

(10) Patent No.: US 7,507,085 B2
(45) Date of Patent: Mar. 24, 2009

(54) GAS REGULATING FITTING

(75) Inventors: Barbara Happe, Gernrode (DE); Frank Pusch, Thale (DE)

(73) Assignee: Mertik Maxitrol GmbH & Co. KG, Thale (DE)

( * ) Notice: Subject to any disclaimer, the term of this patent is extended or adjusted under 35 U.S.C. 154(b) by 0 days.

(21) Appl. No.: 10/547,395

(22) PCT Filed: Feb. 26, 2004

(86) PCT No.: PCT/EP2004/001885

§ 371 (c)(1),
(2), (4) Date: Aug. 6, 2008

(87) PCT Pub. No.: WO2004/079265

PCT Pub. Date: Sep. 16, 2004

(65) Prior Publication Data

US 2006/0172237 A1 Aug. 3, 2006

(30) Foreign Application Priority Data

Mar. 3, 2003 (DE) ..... 103 09 469

(51) Int. Cl.
*A01G 13/06* (2006.01)

(52) U.S. Cl. ..... 431/18

(58) Field of Classification Search ..... 137/66, 137/382; 431/42, 47, 77, 255, 43–46, 50–54, 431/59, 153, 57; 251/129.03; 200/333; 236/1 H; 74/553; 126/42, 39 BA
See application file for complete search history.

(56) References Cited

U.S. PATENT DOCUMENTS

| | | | | |
|---|---|---|---|---|
| 3,770,363 | A * | 11/1973 | Friedrich | 431/47 |
| 4,850,530 | A | 7/1989 | Uecker | |
| 4,975,043 | A * | 12/1990 | Katchka et al. | 431/54 |
| 5,203,688 | A * | 4/1993 | Dietiker | 431/51 |
| 5,722,823 | A * | 3/1998 | Hodgkiss | 431/43 |

FOREIGN PATENT DOCUMENTS

| | | |
|---|---|---|
| DE | 103 05 929 B3 | 9/2004 |
| GB | 2 295 220 A | 5/1996 |
| GB | 2 351 341 A | 12/2000 |
| WO | WO 99/22175 | 5/1999 |
| WO | WO 02/35152 A1 | 5/2002 |

* cited by examiner

*Primary Examiner*—Kenneth Bomberg
*Assistant Examiner*—Daniel A Bernstein
(74) *Attorney, Agent, or Firm*—Howard & Howard Attorneys PLLC

(57) ABSTRACT

A gas regulating fitting that, in addition to enabling an electronic ignition of the gas flow, also permits a manual ignition. A covering element (17) is displaceably mounted on the housing (1) of the gas regulating fitting and, in a first position, covers a tappet (10; 14), which is provided for actuating a thermoelectric ignition safety valve (26) and a main valve (19), and covers a control switch (13) of a piezoelectric igniting element. When the covering element (17) is in a second position, an actuation of the tappet (10; 14), which inevitably occurs when the covering element (17) is displaced, ensures that the main valve (19) is located in the closed position. In addition, the control switch (13) and the tappet (10, 14) are released in this position in such a manner that an ignition of the gas flow is made possible by a manual actuation thereof.

5 Claims, 5 Drawing Sheets

View B

View A

View B

GAS REGULATING FITTING

TECHNICAL AREA

Figure 1:
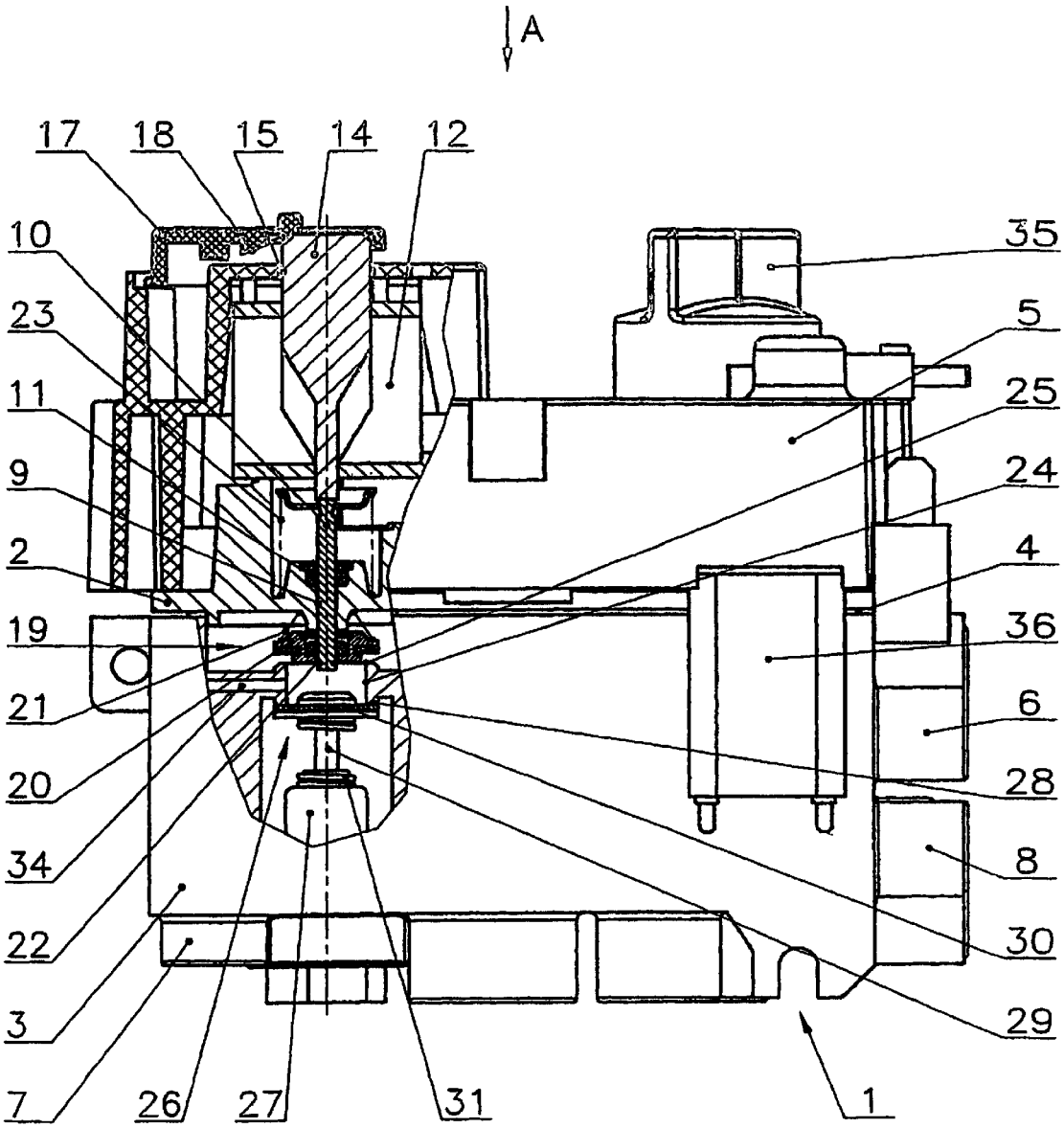

The invention concerns a gas regulating valve with electronic ignition for a gas heating stove in accordance with the specifications for the first patent claim.

PRIOR ART

Gas regulatory fittings for a gas heating stove or the like are available in a large number of designs. They serve to ignite and regulate a stream of gas flowing into a burner. As the installation location for an adjustment is often unsuitable there are now solutions in which electronics are used.

DE application ref. 103 05 929.6 describes a process and an arrangement for igniting a gas stream. Here, in order to ignite a gas stream an ignition locking magnet is triggered via an electronic control unit by generating a holding current supplied from an electricity source to keep open a thermoelectric ignition locking valve blocking off the gas stream. As soon as the ignition locking magnet is energised, an electromagnet is briefly energised by a voltage pulse, so that an actuating strut aligned with the ignition locking valve can be moved so far in a longitudinal direction against the force of a restoring spring that the ignition locking valve, the valve disc of which is supported on a valve rod and loaded in the direction of closure by a restoring spring, opens and positions the anchor of the ignition locking magnet, which is firmly connected to the valve rod. The anchor is restrained by a holding current coming from the electricity source until the gas stream is ignited and a thermocouple provides the necessary holding current. On the one hand the winding of the ignition locking magnet lies within the circuit of a thermocouple that can be heated by the pilot light and on the other be controlled by the electronic control unit.

In this respect it is a disadvantage that if there is a breakdown of the electricity source, such as for example empty batteries or a fault, although it may be possible to continue running the gas heating stove, it is no longer possible to re-ignite the gas stream after switching off and so starting the gas heating stove is, no longer possible either.

Another design of a gas ignition device for controlling the ignition of a gas burner electrically is familiar from GB 2.295.220 A. Here a magnet coil is connected by a switch to a mains voltage source. Energising the magnet coil opens a gas valve via an actuator, so that the gas can flow to the burner where it is ignited electrically. After a fixed period of time has elapsed the magnet coil will be disconnected from the electrical supply system and the actuator will return to its initial position. Keeping the gas valve open is taken over by a magnet unit, which is supplied with current by a thermocouple subject to the influence of a burning gas flame.

In order to prevent the gas valve closing if there is a drop-out of the electricity supply while the gas burner is in operation, the gas ignition device can be equipped with an additional battery, which can maintain operation to a limited extent, or the actuator can be operated manually for the same reason to open the gas valve.

With this design it is not possible to ignite the gas burner if the electricity supply drops out either. It is also a disadvantage that protection from unwanted manual operation of the actuator, as provided for to maintain the gas stream to the gas burner in case of a breakdown, does not exist.

PRESENTING THE INVENTION

The invention is based on the problem of also facilitating manual ignition of the gas stream for gas regulating valves with electronic ignition. But unwanted manual operation should be prevented. Apart from this and irrespective of the nature of the ignition it must be a guaranteed that the main gas stream to the burner should be interrupted especially at ignition. Furthermore the gas regulating valve should have as simple a design as possible.

According to the invention the problem is solved by locating a masking element on the housing, that in an initial position covers a tappet serving to activate a thermoelectric ignition locking valve and a main valve projecting from the gas-bearing chamber of the housing and can be activated in a longitudinal direction, and a key of a piezoelectric ignition element. In a second position of the masking element an inevitable actuation of the tappet on adjustment of the masking element ensures that the main valve is in a closed position. Furtherermore in this position the key and the tappet are enabled so that the gas stream can be ignited by manual operation.

This has found a solution, which remedies the aforementioned disadvantages of prior art. The masking element certainly prevents an undesired manual operation igniting the gas stream. Nevertheless, if needed, such as with a power failure, it is simple to ignite the ignition stream manually. Irrespective of how ignition occurs the main gas stream to the burner is guaranteed to be interrupted on ignition. In this the solution is distinguished by its simple design and simple manner of operation.

Other advantageous embodiments of the invention are derived from the other patent claims.

One advantageous embodiment of the gas regulating valve arises when the masking element has a link track, the pitch of which is fixed so that in the second position the main valve is in the closed position. For handling it is useful, if the link track also has a notch for the first and second positions of the masking element.

Furthermore the solution is especially simple if the masking element is disc-shaped and located centrally and free to rotate on a pin. For this the masking element has clearances, which in the second position release the pushbutton and the tappet.

For manufacturing reasons in particular it will be a beneficial design if the tappet is segmented.

EMBODIMENT

Figure 2:
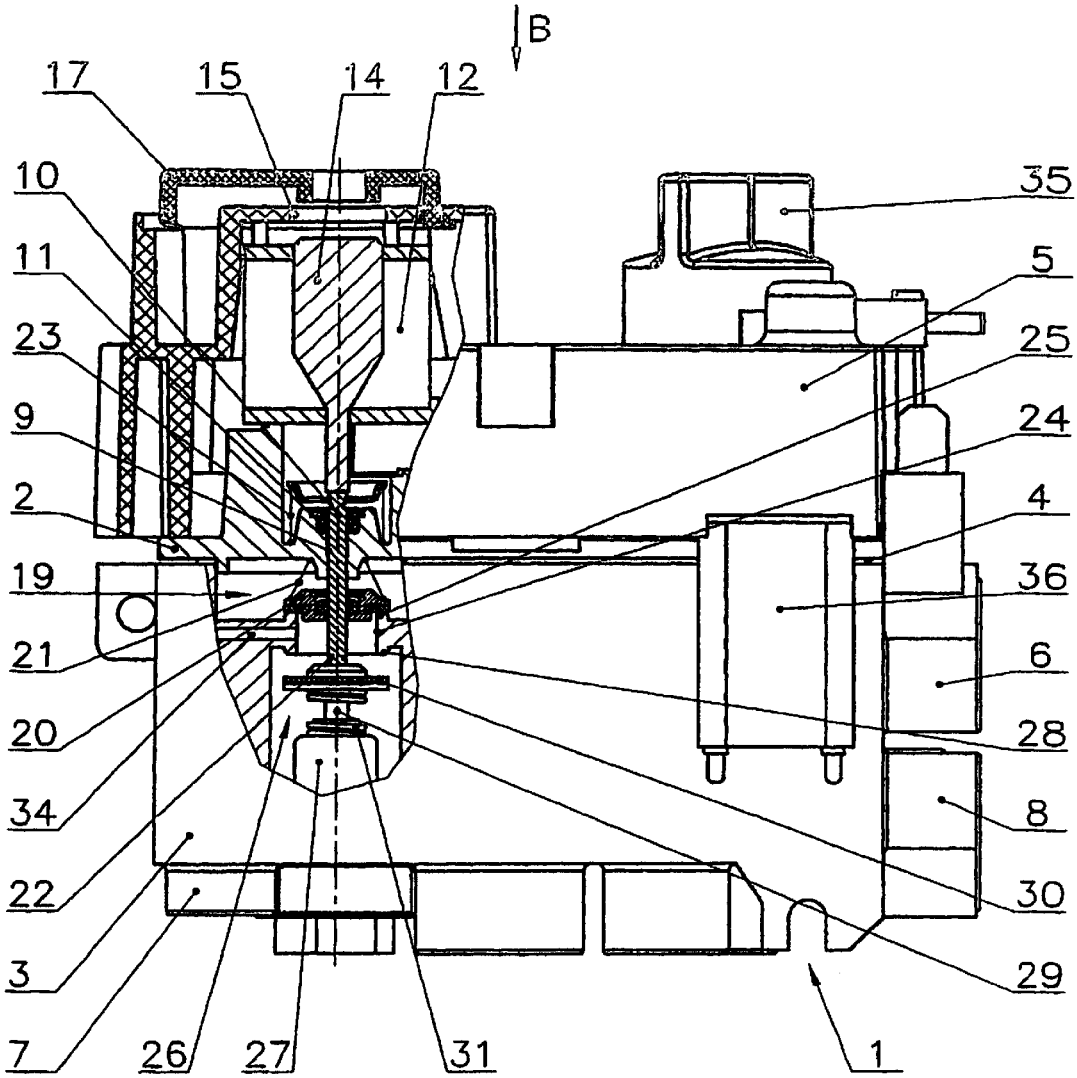
Figure 3:
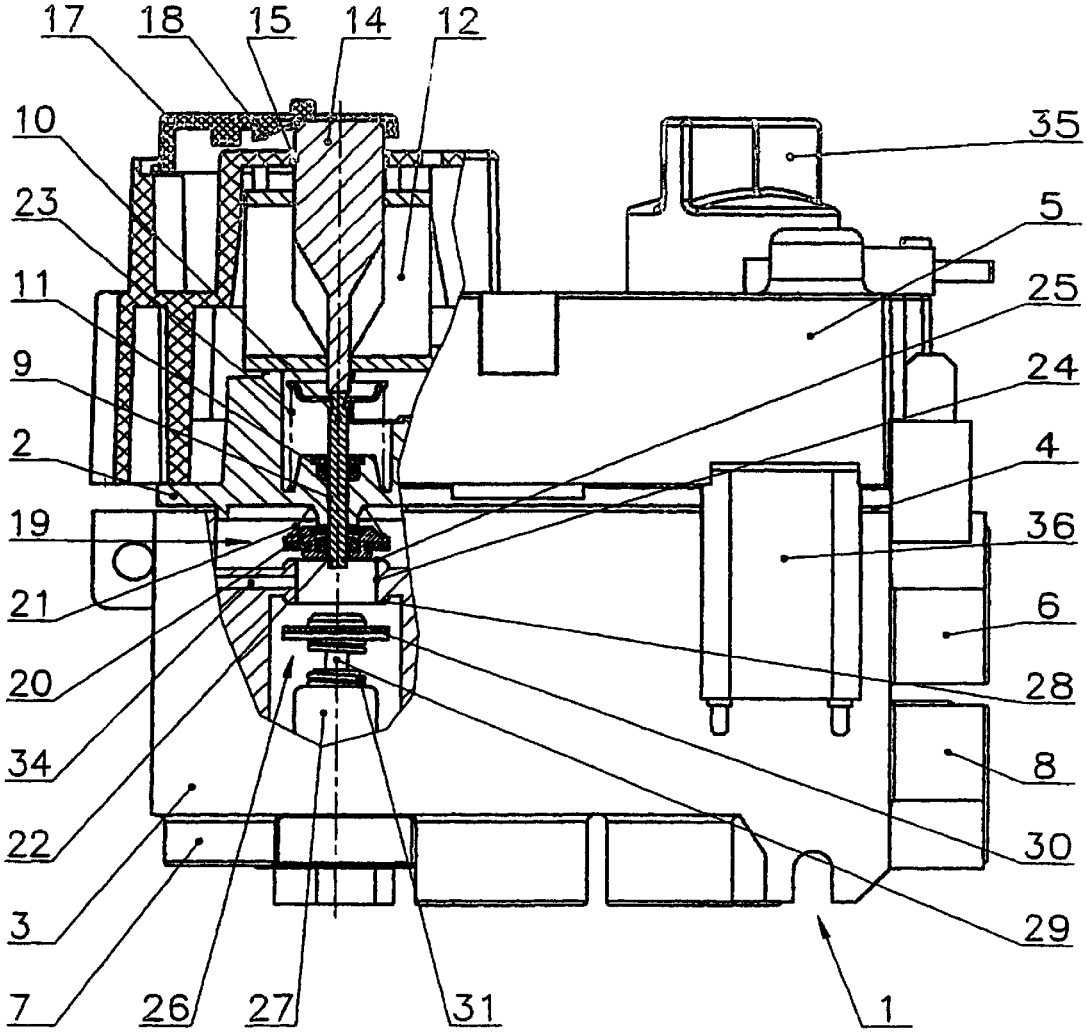
Figure 4:
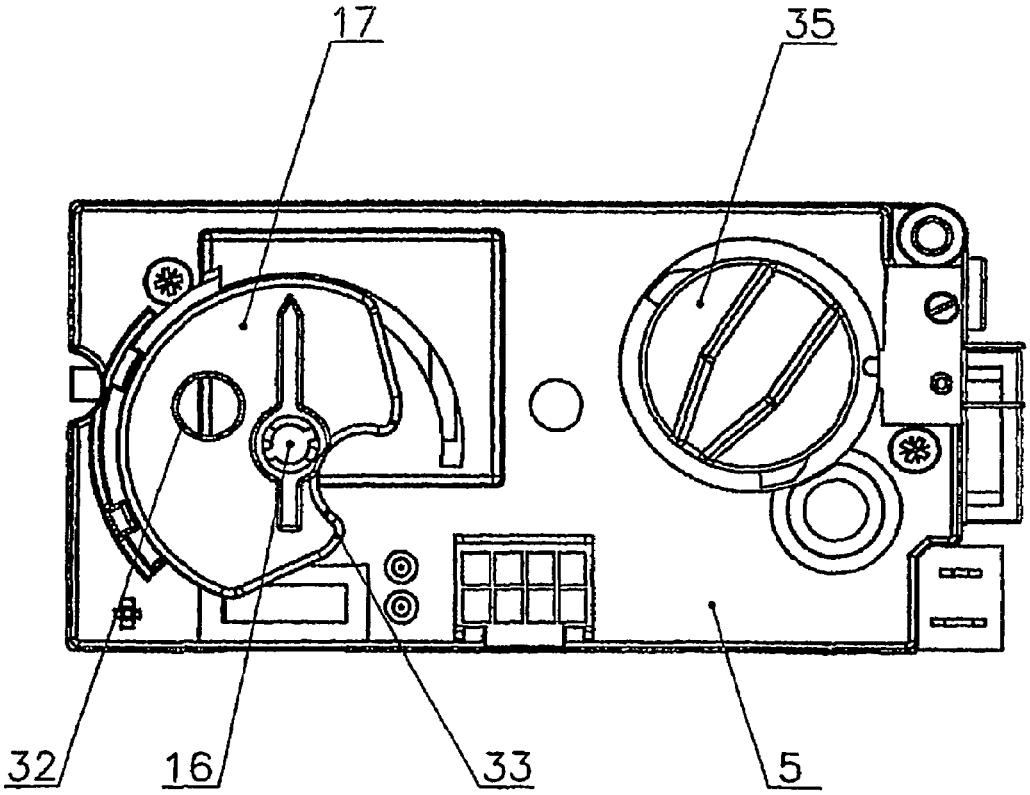
Figure 5:
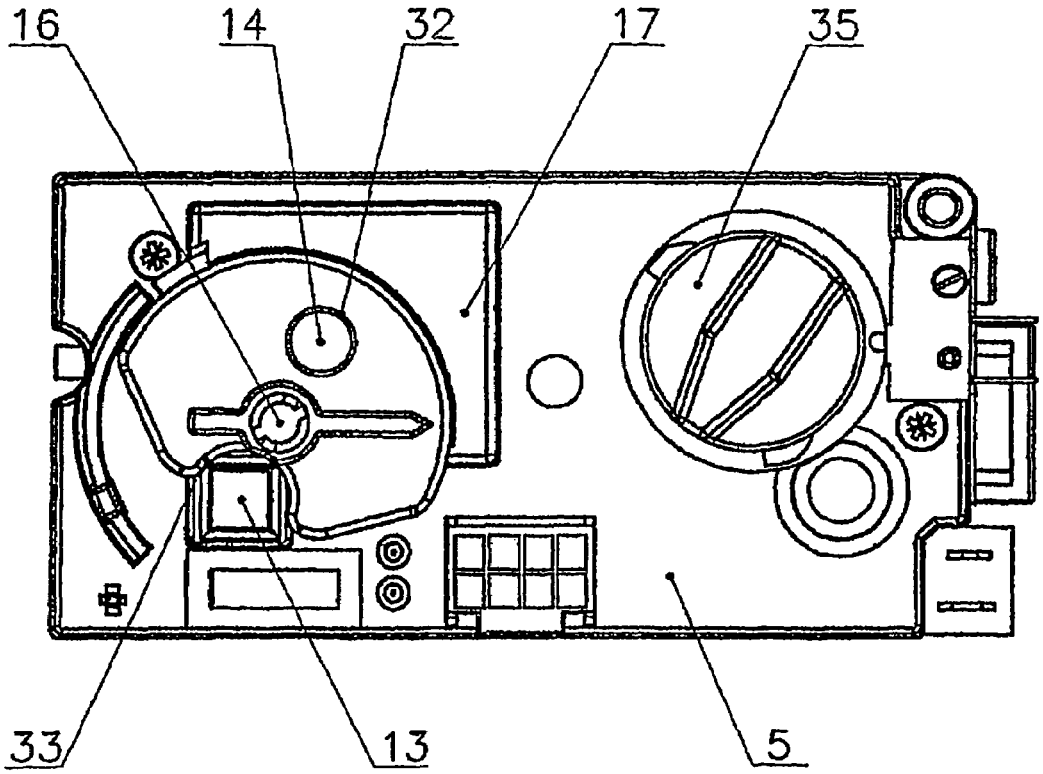

The invention is explained in detail below as an embodiment. These are as follows:

FIG. 1 a construction of a gas regulating valve in accordance with the invention in partial cross-section in the closed position at the "electronic ignition" setting, FIG. 2 a construction of a gas regulating valve in accordance with the invention in partial cross-section at the "manual ignition" setting, FIG. 3 a construction of a gas regulating valve in accordance with the invention in partial cross-section in the open position, FIG. 4 a view A of the gas regulating valve in accordance with the invention from FIG. 1, FIG. 5 a view B of the gas regulating valve in accordance with the invention from FIG. 2.

The gas regulating valve in accordance with the invention exemplified in FIG. 1 is a switching and regulatory device that preferably intended for installation in a gas-heated chimney stove or similar. It facilitates the operation and monitoring of a burner where the gas volume flowing to the burner is controlled. The burner consists in this embodiment of an ignition burner (not shown) and a main burner (also not shown).

This gas regulating valve consists of a housing 1, containing various functional units, which can be partially activated from outside using operating controls. The housing is made up of an upper part 2 and a lower part 3, between which a gasket 4 ensures leakpfroof closure from the outside, and a masking hood 5. In addition to this the housing consists of a gas input 6, a gas output 7, and a main gas output 4.

The gas regulating valve described in this embodiment has the following functional units:

start-up with safety pilot control unit for the gas volume flowing to the main burner piezoelectric ignition element It is triggered by any electronic control unit (not shown), which is in a separately located housing of a remote control together with an electricity source.

For start-up an actuating strut 10, the end of which extends into the inside of the housing, which can be operated by remote control 6 via an electromagnet 11 placed on housing 1, is fed so as to be movable lengthwise in a bearing 9 of housing 1, with the necessary gastightness being provided by O-rings 11 for example. An electromagnet 12 that can be actuated via the remote control is attached between the upper part 2 and the masking hood 5. There is also a piezoelectric ignition element in this chamber that can be activated manually via a pushbutton 13 extending from the masking hood 5.

Electromagnet 12 has a core 14 axially movable to the actuating strut 10, which together with the actuating strut 10 forms a tappet 10/14. The reason for splitting the tappet 10/14 is the resultant simplification in terms of installation, The face of the core 14 turned away from the housing 1 is visible through a recess 15 in the masking hood 5.

On a pin 16 in the masking hood 5 a disc-shaped masking element 17 is located so as to be free to rotate, with a link track 18 acting on the core 14. In an initial notch position (FIG. 4) the masking element 17 closes the pushbutton 13 and the recess 15, whereupon in a second notch position (FIG. 5) resulting from the rotation the pushbutton 13 and the core 14 of the electromagnet 12 are freely accessible through clearances 32/33 in the masking element 17.

On the area of the actuating strut 10 projecting into the interior of the upper portion 2 a valve disc 20 belonging to a main valve 19 is passed through so as to be movable, and is supported on a limit stop 22 formed on a lock washer mounted on a slot for example, located on the actuating strut 10, which, subject to the force of a recoil spring 21, bears on the one hand against upper part 2 and on the other against valve disc 20. Movement of the actuating strut 10 in a longitudinal direction is only possible against the force of a restoring spring 23 supported in housing 1. The starting position to be adopted under the force of restoring spring 23 is reached by the valve disc 20 of the main valve 19 bearing against upper part 2.

The interior of the part of the housing formed by upper part 2 and lower part 3 is divided into different compartments by a partition 24. In alignment with and as an extension to the actuating strut 10 the partition 24 has an aperture, of which the side turned towards the upper part 2 forms the valve seat 25 for the valve disc 20, and so in connection with this forms the main valve 19, whereas the other side forms a valve seat 28 forming part of an ignition locking valve. Between both valve seats 25/28 an ignition gas borehole leading to ignition gas output 7 discharges into the aperture. The ignition locking valve 26 is influenced by a thermoelectric ignition locking magnet 27 downstream from gas input 6 placed gas-tight in a bearing of housing 1. The thermoelectric ignition locking magnet 27 acts on an anchor 19, which is rigidly linked to a valve stem 29, on which the valve disc 30 of ignition locking valve 26 is fastened. The thermoelectric ignition locking magnet 27 can be energised via the electronic control unit and via a thermocouple exposed to the pilot light.

The design and operation of ignition locking magnet 27 are otherwise familiar to specialists so that it is unnecessary to describe further details. It only needs to be emphasised that a restoring spring 31 endeavours to withdraw the anchor from the ignition locking magnet 27 via the valve disc 30 serving as a spring hanger.

In the direction of flow behind the start up there is a switch inside the housing 1, which controls the volume of gas flowing to the main burner. The switch is designed so that a modulating control via an initial valve 32 with a stepwise on and off switch in the part-load area is effected via a second valve. The part-load throughput is limited by an adjustable jet. A tappet lengthwise movable and frictionally connected with the switch projects from the housing 1, which at the same time forms a bearing for it. The necessary external gastightness is ensured by an O-ring for example. The end of the tappet turned away from the switch is connected to an operating element 35. The external circumference of operating element 35 has some toothing with which a pinion forming part of a step-up gear engages. The step-up gear is coupled to a drive unit 36 fastened to housing 1, consisting of an electric motor. To avoid overloading the motor, a slip clutch, familiar to specialists and not therefore explained in any further detail, is located between the drive unit 36 and the operating element 35. The drive unit 36 is triggered by remote control 6 via the electronic control unit.

With a normal function of the gas regulating valve the electronic control unit is activated via the remote control. This activates the electromagnet 12 by electric pulse so that the core 14 moves the actuating strut 10 in the direction of the ignition locking valve 26. First of all this closes the main valve 19 and then opens the ignition locking valve 26 wide enough for the anchor to bear against the ignition locking magnet 27 (FIG. 2). Apart from this the ignition locking magnet 27 is energised via the electronic control unit, so that from the time that the anchor strikes the ignition locking magnet 27, the anchor is held in this position by the flow of holding current, i.e. in the open position of ignition locking valve 27, while the actuating strut 10 re-adopts its starting position because electromagnet 12 is de-energised after the pulse comes to an end and is subject to the effect of the restoring spring 23. The ignition gas can flow via the ignition gas borehole 34 to the ignition gas output 7 and from there via an ignition gas feed (not shown) to the ignition burner where it is ignited.

As soon as the pilot light is alight the drive unit 36 can be activated via the electronic control unit. This opens the switch in a familiar manner, resulting in an abrupt opening of the second valve. The constant volume of gas limited by an aperture flows over the main gas output 8 via a main gas feed (also not shown) to the main burner and is ignited by the pilot light. The flames burn at a minimal level. Further operation of drive unit 36 results in the volume of gas flowing to the main gas burner being uniformly increased as now the first valve continuously opens, achieving a uniform increase in the volume of gas flowing through the first valve until the maximum gas volume is reached.

If the electronic control unit breaks down, for example as a result of a power failure due to flat batteries, the masking element 17, which is normally in the first notch position assigned to the electronic ignition shown in FIG. 4 is rotated into the position displayed in FIG. 5. With this movement the link track 18 moves the core 14 far enough in a longitudinal direction for the actuating strut 10 to close the main valve 19. With the help of an ordinary household item manual force on the face of the core 14 now pushes the actuating strut 10 far enough in for the ignition locking valve 26 to open (FIG. 2). Maintaining the application of this force actuates the pushbutton 13 of the piezoelectric ignition device and ignites the ignition gas with the resultant spark.

After the thermocouple has been heated by the burning pilot light, so that the necessary holding current is available, the force applied to the core can be ended and the masking element 17 brought into the position shown in FIG. 4. Under the force of the restoring spring 23 the actuating strut 10 and the pushbutton 13 take up their initial position. The main valve 19 is opened and the ignition locking valve 26 is held in familiar fashion by the thermoelectric ignition locking magnet 27 (FIG. 3). Manual operation of the operating element 35 via the switch now allows the volume of the gas flowing to the main burner to be regulated.

The process that is the subject of the invention and the arrangement for carrying out the process are not of course limited to the embodiment described. Alterations, adaptations and combinations are possible without departing from the scope of the invention. It is evident that the gas regulating valve for example can have further function units such as a pressure controller etc., apart from those mentioned.

LIST OF REFERENCE MARKS

1 housing
2 upper part
3 lower part
4 gasket
5 masking hood
6 gas input
7 ignition gas output
8 main gas output
9 bearing
10 actuating strut
11 O-ring
12 electromagnet
13 pushbutton
14 core
15 recess
16 pin
17 masking element
18 link track
19 main valve
20 valve disc
21 recoil spring
22 limit stop
23 restoring spring
24 partition
25 valve seat
26 ignition locking valve
27 ignition locking magnet
28 valve seat
29 valve rod
30 valve disc
31 restoring spring
32 clearance
33 clearance
34 ignition gas borehole
35 operating element
36 drive unit

The invention claimed is:

1. Gas regulating valve with electronic ignition for a gas-heated chimney stove or similar with a thermoelectric ignition locking valve (26) and a main valve (19), which jointly serve both as a pilot light and to split the gas flow into components for a main burner and an ignition burner, and which are accommodated with other secondary functional elements in a segmented housing (1), a tappet (10; 14) located axially to the ignition locking valve (26) and the main valve (19) and which projects from a gasbearing chamber of the housing (1) and can be actuated longitudinally against the force of a restoring spring (23) via an electromagnet (12), said gas regulating valve having a masking element (17) located on the housing (1), that in an initial position masks the tappet (10; 14) and a pushbutton (13) of a piezoelectric ignition element, and when the masking element is in a second position the main valve (19) is in the closed position and the pushbutton (13) and the tappet (10; 14) are enabled so that the gas stream can be ignited by manual operation.

2. Gas regulating valve electronic ignition in accordance with patent claim 1, having the masking element (17) with a link track 18),having a pitch which is fixed so that in the second position the main valve (19) is in the closed position.

3. Gas regulating valve with electronic ignition in accordance with patent claim 2, having the link track (18) with notches for both the initial position and the second position of the masking element (17).

4. Gas regulating valve with electronic ignition in accordance with claim 1,having the masking element (17) located centrally so as to be free to rotate on a pin (16) with clearances (32; 33), which in the second position release the pushbutton (13) and the tappet (10; 14).

5. Gas regulating valve with electronic ignition in accordance with claim 1, having the tappet (10; 14) segmented.

* * * * *

UNITED STATES PATENT AND TRADEMARK OFFICE

CERTIFICATE OF CORRECTION

PATENT NO. : 7,507,085 B2
APPLICATION NO. : 10/547395
DATED : March 24, 2009
INVENTOR(S) : Barbara Happe and Frank Pusch It is certified that error appears in the above-identified patent and that said Letters Patent is hereby corrected as shown below:

In Column 6, Line 42, please insert --(-- between “track” and “18)”

Signed and Sealed this

Twenty-eighth Day of April, 2009

JOHN DOLL
*Acting Director of the United States Patent and Trademark Office*